US005839913A

United States Patent [19]

Fumikura

[11] Patent Number: 5,839,913

[45] Date of Patent: Nov. 24, 1998

[54] EDGE CONNECTOR HAVING LATCHES FOR MULTIPLE DAUGHTER BOARDS

[75] Inventor: Tadahiro Fumikura, Ichikawa, Japan

[73] Assignee: The Whitaker Corporation, Wilmington, Del.

[21] Appl. No.: 793,831

[22] PCT Filed: May 28, 1996

[86] PCT No.: PCT/US96/07797

§ 371 Date: Feb. 18, 1997

§ 102(e) Date: Feb. 18, 1997

[87] PCT Pub. No.: WO97/00545

PCT Pub. Date: Jan. 3, 1997

[30] Foreign Application Priority Data

Jun. 15, 1995 [JP] Japan ..... 7-149041

[51] Int. Cl.[6] ..... H01R 13/62

[52] U.S. Cl. ..... 439/326; 439/328

[58] Field of Search ..... 439/326, 327, 439/328, 630, 631, 636, 637, 541.5, 59, 60, 61, 62

[56] References Cited

U.S. PATENT DOCUMENTS

| | | | |
|---|---|---|---|
| 4,946,403 | 8/1990 | Billman et al. | 439/631 |
| 5,116,237 | 5/1992 | Loewen | 439/326 |
| 5,425,651 | 6/1995 | Thrush et al. | 439/630 |
| 5,562,461 | 10/1996 | Obara et al. | 439/326 |
| 5,632,640 | 5/1997 | Noda | 439/326 |
| 5,641,295 | 6/1997 | Koyama | 439/326 |
| 5,697,802 | 12/1997 | Kawabe | 439/326 |

*Primary Examiner*—Gary F. Paumen
*Assistant Examiner*—Tho Dac Ta
*Attorney, Agent, or Firm*—Robert Kapalka

[57] ABSTRACT

An edge connector for a plurality of daughter boards has a plurality of adjacent board-receiving openings which are configured to receive the daughter boards first in a common linear insertion direction at respective upstream positions and then in a common pivoting insertion direction to respective downstream positions. A plurality of latch members are operable to retain the daughter boards in their respective downstream positions. The latch members are also releasable to allow reverse pivoting of the daughter boards. The latch members are configured so that releasing the latch members associated with a relatively downstream one of the openings operates to release the latch members associated with relatively upstream ones of the openings, thereby preventing collisions between adjacent ones of the daughter boards.

2 Claims, 3 Drawing Sheets

EDGE CONNECTOR HAVING LATCHES FOR MULTIPLE DAUGHTER BOARDS

The present invention concerns an edge connector which electrically connects daughter boards such as memory cards or the like to a mother board.

Edge connectors which electrically connect daughter boards such as memory cards or the like to mother boards have been known in the past (for example, see Japanese Utility Model Application Kokai No. 4-38093, Japanese Patent Application Kokai No. 6-31088 and Japanese Patent Application Kokai No. 6-111887). Generally, edge connectors have a C-shaped configuration with a housing which receives the leading edge portion of a daughter board, the leading edge having a plurality of conductive pads thereon, and arm parts which receive both side edges of the daughter board. An array of terminals are arranged in rows in the housing. The daughter board is electrically connected to the mother board by the connection of the respective terminals with the conductive pads of the daughter board.

Among the conventional edge connectors mentioned above, the edge connector disclosed in Japanese Patent Application Kokai No. 6-111887 is an edge connector in which a daughter board is connected to a mother board by first inserting the leading edge portion of the daughter board with a linear motion into a long, slender board-receiving opening in the housing of the edge connector, and then pivoting the daughter board in one direction about the leading edge portion.

In cases where a plurality of daughter boards are to be held by an edge connector of this type, the following structure is conceivable: a plurality of the board-receiving openings described above are formed adjacent to each other in the housing; respective daughter boards are inserted into this plurality of board-receiving openings, and these daughter boards are pivoted as described above so that the daughter boards are held by latch members, thus causing a plurality of daughter boards to be held in the edge connector.

In edge connectors having such a structure, the daughter boards held in the edge connector are removed as follows: the latch members holding the daughter board which is to be removed are released, and the daughter board is reverse pivoted and then withdrawn in a direction opposite to the insertion direction described above. A problem arises when it is desired to remove one daughter board from among the plurality of daughter boards which are held by latch members in the connector. In that case, the daughter board will reverse pivot in a direction which causes it to collide with an adjacent daughter board positioned on the upstream side (with respect to the pivoting insertion direction). Thus, the daughter board on the upstream side will interfere with removal of the one daughter board, thereby preventing its removal, causing damage to the daughter boards, or both.

The present invention was devised to overcome the stated problem. An advantage of the present invention is that an edge connector which accommodates a plurality of daughter boards which are pivotally inserted into the connector may have any one of the daughter boards removed from the connector without interference from an adjacent daughter board.

The present invention provides an edge connector for interconnecting a plurality of daughter boards with a mother board, the edge connector including a housing having a plurality of adjacent board-receiving openings each configured to receive an edge portion of a respective one of the daughter boards, the daughter boards being insertable first in a common linear insertion direction and then being pivotable about their respective edge portions from respective upstream to downstream positions in a common pivoting insertion direction, a plurality of terminals disposed in the housing for electrically interconnecting respective conductive pads on the edge portions of the daughter boards with the mother board, and a plurality of latch members attached to the housing and associated with respective ones of the openings, the latch members being operable to retain the daughter boards in their respective said openings when the daughter boards are pivoted to their respective downstream positions, and the latch members being releasable to allow reverse pivoting of the daughter boards, characterized in that: releasing the latch members associated with a relatively downstream one of the openings operates to release the latch members associated with relatively upstream ones of the openings.

It is desirable that the plurality of terminals described above includes a first group of terminals which are inserted into the housing in one direction, and a second group of terminals which are inserted into the housing in an opposite direction.

The invention will now be described by way of example with reference to the accompanying drawings wherein.

Figure 1:
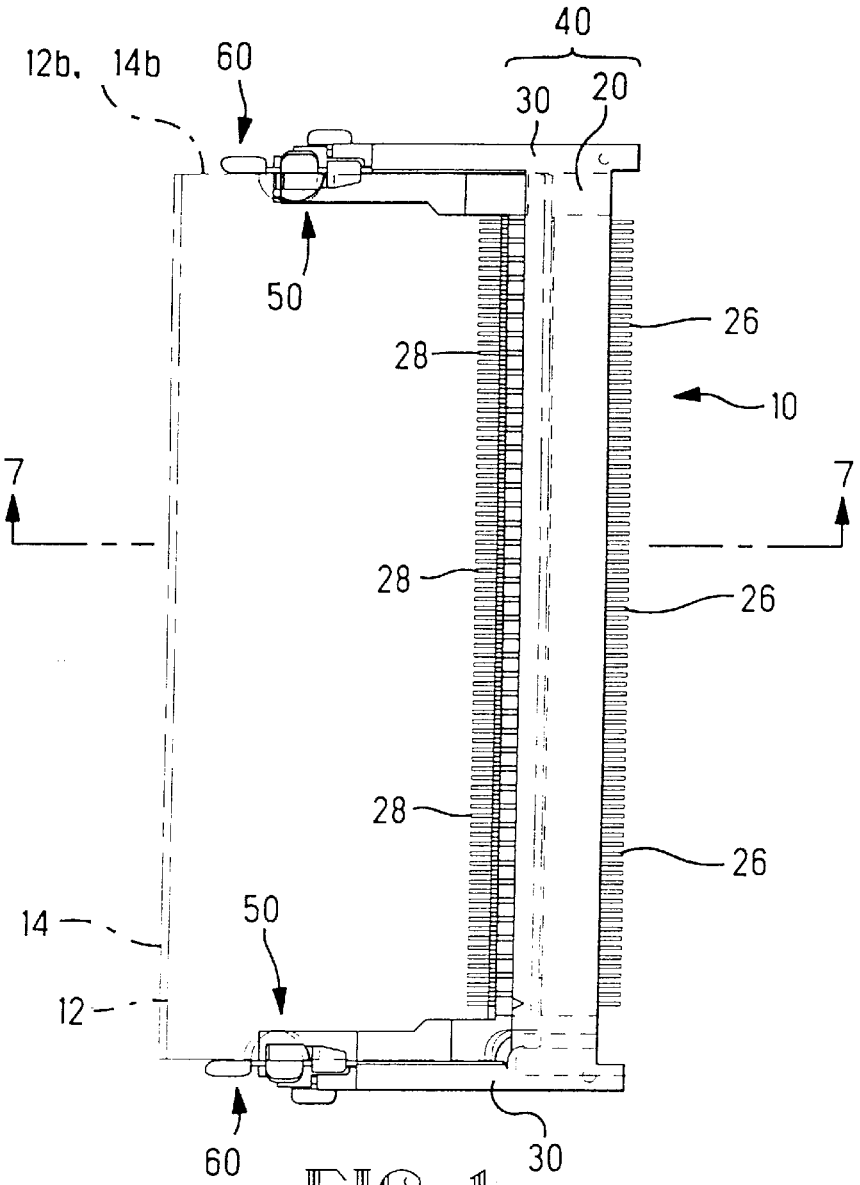
FIG. 1 is a plan view which illustrates the edge connector.
Figure 2:
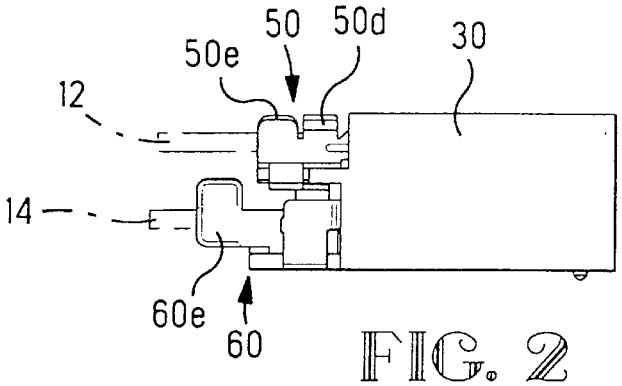
FIG. 2 is a side view of the edge connector.
Figure 3:
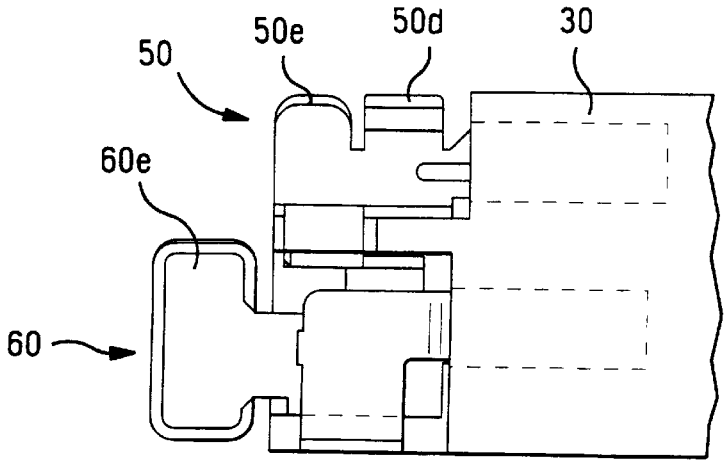
FIG. 3 is a partial enlargement of the edge connector shown in FIG. 2.
Figure 7:
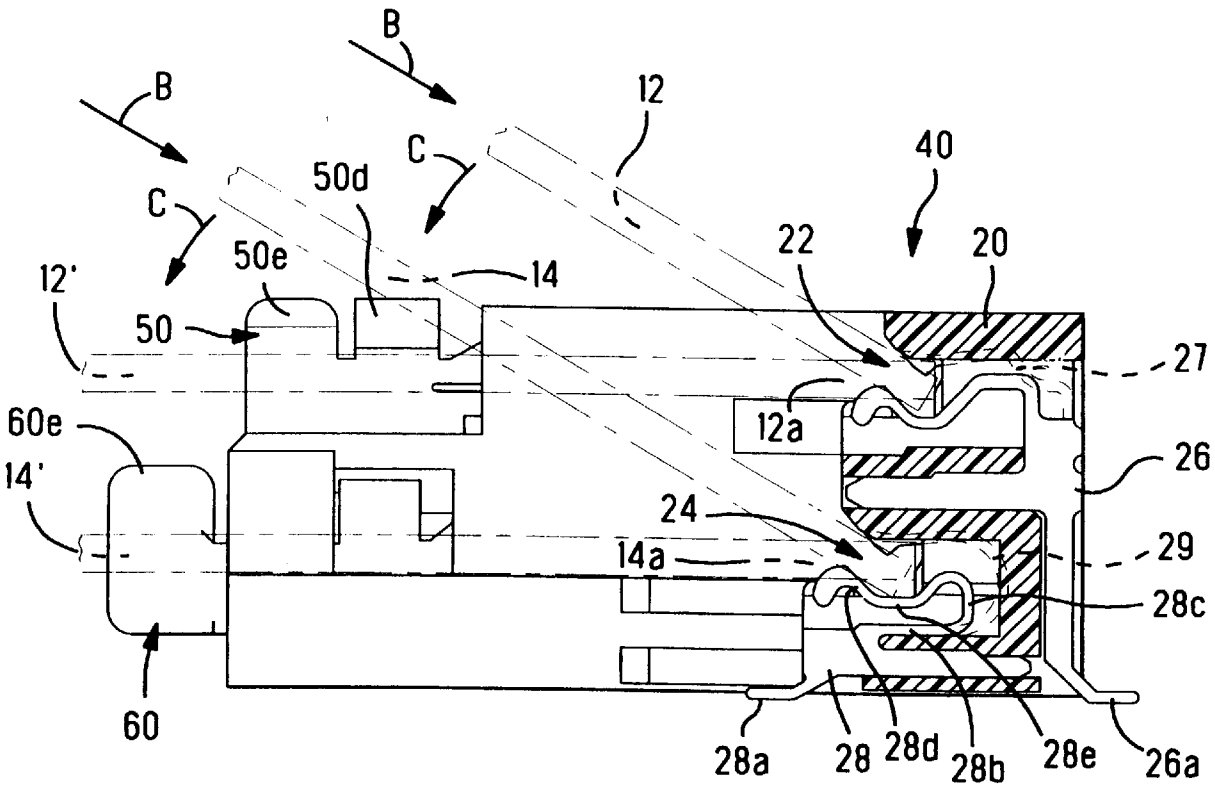
FIG. 7 is a cross-sectional view taken along line 7—7 in FIG. 1.
Figure 8:
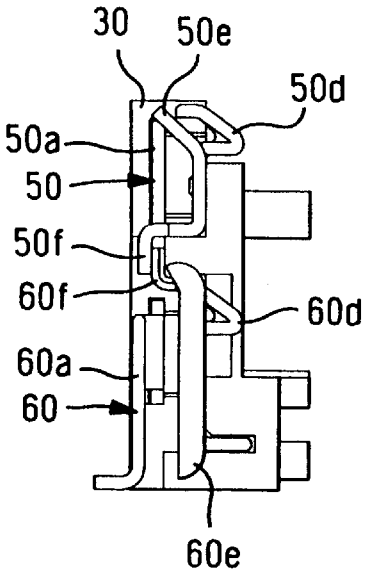
FIG. 8 is a front view of the connector shown in FIG. 7.

With reference to FIGS. 1 and 7, edge connector 10 has a C-shaped housing 40 which is constructed from a base part 20 and a pair of arm parts 30 which protrude in a forward direction from both ends of the base part 20, and latch members 50 and 60 which are attached to the arm parts 30. The edge connector 10 is designed to hold two daughter boards 12 and 14 which have a plurality of conductive pads (not shown in the figures) formed on their leading edge portions 12*a* and 14*a*.

As shown in FIG. 7, the daughter boards 12 and 14 are moved in a linear insertion direction B to introduce the leading edge portions 12*a* and 14*a* into board-receiving openings 22 and 24, respectively, which are formed adjacent to each other in the base part 20. The board-receiving opening 24 is one example of a first board-receiving opening of the present invention. A plurality of terminals 26, 27, 28, 29 which contact the conductive pads on the leading edge portions are installed in respective rows in the board-receiving openings 22 and 24, forming two terminal groups (upper and lower). The plurality of terminals 28 constitute one example of a first terminal group of the present invention, and the plurality of terminals 26 constitute one example of a second terminal group of the present invention. The terminals 26 and 28 have respective tine parts 26*a* and 28*a* which are connected to the mother board (not shown in the figures) by soldering. The terminals 27 and 29 also have tine parts; however only the terminals 26 and 28 will be described here. The tine parts 28*a* of the terminals 28 are positioned forwardly of the board-receiving opening 24, while the tine parts 26*a* of the terminals 26 are positioned on the opposite side of the base part 20 from the tine parts 28*a*. Accordingly, since the tine parts 26*a* and 28*a* of the terminals 26 and 28 are separated by the base part 20, the edge connector 10 can be connected to the mother board firmly and with good balance. Furthermore, the terminals 28 are inserted into the board-receiving opening 24 from the front of the board-receiving opening 24, while the terminals 26 are inserted into the board-receiving opening 22 in an opposite direction from the rear of the board-receiving opening 22. Accordingly, the terminals 26 and 28 can be disposed with a greater density in the edge connector 10 compared to a case in which the terminals are all inserted from the same direction. Furthermore, the terminals 28 each have a first contact part 28*b* which extends rearwardly to a tip 28*c*, and then a second contact part 28*d* which extends forwardly in the board-receiving opening 24. Furthermore, the second contact part 28*d* has a central portion 28*e* which is bent in a convex shape toward the first contact part 28*b* and then toward the terminals 26. Accordingly, even if the distance from a fixed end of the first contact part 28*b* to the contact point which contacts the corresponding conductive pad on the daughter board 14 is short, the contact 28 has a contact part with a long length, so that elasticity of the contact part is increased.

Figure 4:
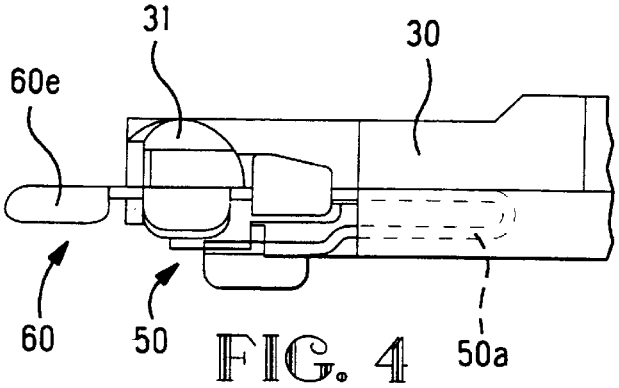
FIG. 4 is a plan view of the edge connector shown in FIG. 3.

Latch members 50 and 60 which anchor or retain both side portions 12*b* and 14*b* of the daughter boards 12 and 14, respectively, are attached to the pair of arm parts 30. The latch members 50 are attached to the pair of arm parts 30 (one latch member 50 to each arm part 30) so that they face the board-receiving opening 22, and the latch members 60 are attached to the pair of arm parts 30 (one latch member 60 to each arm part 30) so that they face the board-receiving opening 24. Furthermore, cutouts (not shown in the figures) are formed in both side portions 12*b* and 14*b* of the daughter boards 12 and 14, and each of the arm parts 30 has a projection 31, shown in FIG. 4, which resides in a respective one of the cutouts when the daughter boards are retained by latches in the edge connector. Accordingly, if the daughter boards 12 and 14 are not fully inserted in their respective board-receiving openings 22 and 24, the side portions 12*b* and 14*b* of the daughter boards will collide with the projections 31 when the daughter boards are pivoted toward the latch members, thereby preventing latching until insertion is completed.

Figure 5:
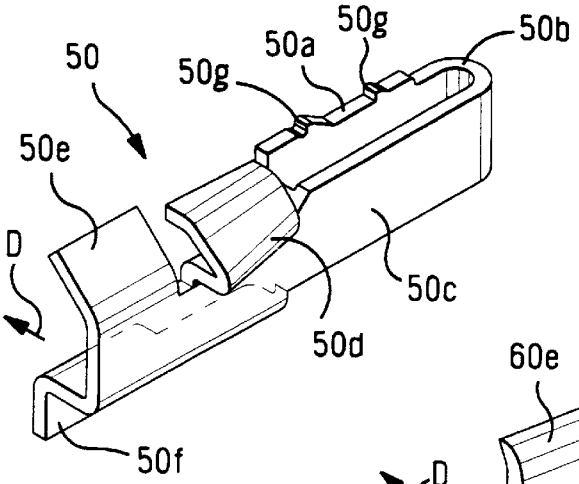
FIG. 5 is an isometric view of an upper latch member which is used in the connector.

With reference to FIG. 5, each latch member 50 has a fixed part 50*a* which is fastened to the corresponding arm part 30, and a movable part 50*c* (with spring elasticity) which is bent toward the other arm part 30 from tip 50*b* of the fixed part 50*a*, and which extends toward the front of the board-receiving opening 22. Barbs 50*g* bite into the arm part 30 when the latch member 50 is press-fitted in the arm part 30. An inclined portion 50*d* which is contacted by the corresponding side portion 12*b* of the daughter board 12 is formed on the movable part 50*c*. An operating part 50*e* which is used to retract the movable part 50*c* in the direction of arrow D is formed at a tip of the movable part 50*c*. In addition, a press part 50*f* which is engaged by a pressing part 60*f* of the corresponding latch member 60 (described later) is formed at a tip of the movable part 50*c*.

Figure 6:
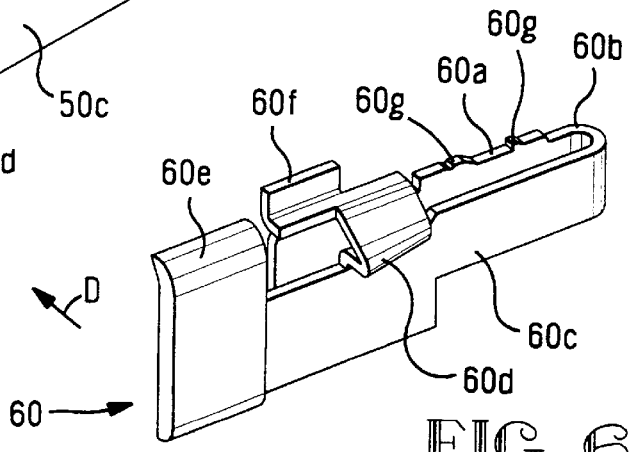
FIG. 6 is an isometric view of a lower latch member which is used in the connector.

With reference to FIG. 6, each latch member 60 has a fixed part 60*a* which is fastened to the corresponding arm part 30, and a movable part 60*c* (with spring elasticity) which is bent toward the other arm part 30 from tip 60*b* of the fixed part 60*a*, and which extends toward the front of the board-receiving opening 24. Barbs 60*g* bite into the arm part 30 when the latch member 60 is press-fitted in the arm part 30. An inclined portion 60*d* which is contacted by the corresponding side portion 14*b* of the daughter board 14 is formed on the movable part 60*c*. An operating part 60*e* which is used to retract the movable part 60*c* in the direction of arrow D is formed at a tip of the movable part 60*c*. In addition, a pressing part 60*f* which engages the press part 50*f* of the corresponding anchoring member 50 is formed on the movable part 60*c*.

In order to insert the daughter boards 12 and 14 in the edge connector 10, the daughter board 14 is inserted first in the edge connector 10, after which the daughter board 12 is inserted in the edge connector 10.

The daughter board 14 is inserted in the edge connector 10 as follows: the leading edge portion 14*a* is inserted into the board-receiving opening 24 in the linear insertion direction B as shown in FIG. 7, and the daughter board 14 is then pivoted in pivoting insertion direction C, whereby the side portions 14*b* contact the inclined portions 60*d* of the latch members 60, and push these inclined portions 60*d* in the pivoting direction C. The terminals 28 exert a force which urges the daughter board 14 to pivot in the opposite direction from the pivoting insertion direction C. However, the force of the terminals 28 can be overcome by continued pushing on the daughter board 14 in the pivoting insertion direction C, and the movable parts 60*c* of the latch members 60 are then caused to move in the direction of arrow D in FIG. 6, so that the daughter board 14 contacts the surfaces beneath the inclined portions 60*d*, and is retained by the latch members 60 in the downstream pivoted position indicated by broken line 14' in FIG. 7. As a result, the daughter board 14 is secured in the edge connector 10, and is electrically connected to the mother board.

Similarly, the daughter board 12 is inserted in the edge connector 10 as follows: the leading edge portion 12*a* is inserted into the board-receiving opening 22 in the linear insertion direction B as shown in FIG. 7, and the daughter board 12 is pivoted in pivoting insertion direction C, whereby the side portions 12*b* of the daughter board 12 contact the inclined portions 50*d* of the latch members 50, and push these inclined portions 50*d* in the pivoting insertion direction C. As a result, the movable parts 50*c* of the latch members 50 move in the direction of arrow D in FIG. 5, so that the daughter board 12 contacts the surfaces beneath the inclined portions 50*d*, and is retained in the downstream pivoted position indicated by broken line 12' in FIG. 7. As a result, the daughter board 12 is secured in the edge connector 10, and is electrically connected to the mother board.

The daughter board 12 is removed from the edge connector 10 as follows: the latch members 50 are released by pushing the operating parts 50*e* in the direction of arrow D, thereby moving the movable parts 50*c* in the direction of arrow D. As a result, the daughter board 12 is released from retention by the latch members 50, whereby the daughter board can be reverse pivoted and removed from the edge connector 10.

Furthermore, the daughter board 14 is removed from the edge connector 10 as follows: the latch members 60 are released by pushing the operating parts 60*e* in the direction of arrow D, whereupon the pressing parts 60*f* come into engagement with the press parts 50*f* of the latch members 50 and cause the press parts 50*f* to move in the direction of arrow D. As a result, the daughter board 12 is released from the latch members 50, and the daughter board 14 is also released from the latch members 60, whereby both of the boards 12 and 14 can be reverse pivoted in a direction opposite to the pivoting direction C. Accordingly, a collision between the daughter boards is prevented.

The embodiment described above concerned an edge connector accommodating two daughter boards. However, an edge connector capable of accommodating three or more daughter boards could also be obtained by increasing the number of board-receiving openings and increasing the number of latch members. In cases where the number of latch members is increased, the latch members which are located farthest upstream with respect to the pivoting direction C are formed with the same shape as the latch members 50 shown in FIG. 5, while the remaining latch members are formed with the same shape as the latch members 60 shown in FIG. 6. In this way, one of the daughter boards which is being removed is prevented from colliding with an adjacent daughter board.

In the edge connector of the present invention, as was described above, a plurality of daughter boards can be connected to a mother board by inserting the respective daughter boards into a plurality of board-receiving openings formed adjacent to each other in the housing of the connector, pivoting the daughter boards in the insertion direction described above, and retaining the respective daughter boards by means of respective latch members. Furthermore, when a daughter board located on the downstream side with respect to the pivoting insertion direction is released, the daughter boards located on the upstream side of this daughter board are also released, thereby preventing collisions between the daughter boards on the upstream side.

What is claimed is:

1. An edge connector for interconnecting a plurality of daughter boards with a mother board, the edge connector including a housing having a plurality of adjacent board-receiving openings each configured to receive an edge portion of a respective one of the daughter boards, the daughter boards being insertable first in a common linear insertion direction and then being pivotable about their respective edge portions from respective upstream to downstream positions in a common pivoting insertion direction, a plurality of terminals disposed in the housing for electrically interconnecting respective conductive pads on the edge portions of the daughter boards with the mother board, and a plurality of latch members attached to the housing and associated with respective ones of the openings, the latch members being operable to retain the daughter boards in their respective said openings when the daughter boards are pivoted to their respective downstream positions, and the latch members being releasable to allow reverse pivoting of the daughter boards, characterized in that:

releasing the latch members associated with a relatively downstream one of the openings operates to release the latch members associated with relatively upstream ones of the openings.

2. An edge connector as defined in claim 1, wherein the plurality of terminals includes a first group of terminals which are inserted into the housing in one direction, and a second group of terminals which are inserted into the housing in an opposite direction.

* * * * *